United States Patent [19]

Terui

[11] Patent Number: 4,493,672

[45] Date of Patent: Jan. 15, 1985

[54] TOY VEHICLE ASSEMBLY

[75] Inventor: Masumi Terui, Matsudo, Japan

[73] Assignee: Takara Co., Ltd., Tokyo, Japan

[21] Appl. No.: 476,821

[22] Filed: Mar. 18, 1983

[30] Foreign Application Priority Data

Dec. 29, 1982 [JP] Japan ..... 57-201733

[51] Int. Cl.[3] ..... A63H 29/00

[52] U.S. Cl. ..... 446/464; 446/470

[58] Field of Search ..... 46/206, 209, 208, 212, 46/211, 201, 202

[56] References Cited

U.S. PATENT DOCUMENTS 2,250,215 7/1941 Berger ..... 46/211 X
3,708,913 1/1973 Terzian et al. ..... 46/202 X
3,914,898 10/1975 Ferguson ..... 46/202
4,329,810 5/1982 Terui .
4,382,347 5/1983 Murakami ..... 46/202 X

FOREIGN PATENT DOCUMENTS 54-164128 11/1979 Japan .

*Primary Examiner*—M. Yu
*Attorney, Agent, or Firm*—Jackson, Jones & Price

[57] ABSTRACT

A toy vehicle assembly that can be self-propelled by a spring motor and is designed to permit the front wheels to be lifted off of the traveling surface by the addition of a weighted member. The weighted member is positioned on a pivotable bracket which is adjustable relative to the main frame of the vehicle to thereby permit a modification in the mode of travel of the vehicle.

19 Claims, 13 Drawing Figures

TOY VEHICLE ASSEMBLY

BACKGROUND OF THE INVENTION

A toy vehicle is provided with a specially constructed support member on the upper body shell of the toy vehicle to receive and removably support a weighted member such as a coin of monetary value of a predetermined weight. The toy vehicle, when propelled forward, provides an impression of high speed acceleration with its front wheel assembly lifting off the support surface as a result of the location and weight of the weighted member.

In general, children find it very amusing to play with a toy vehicle which is propelled by a springwound motor as the power source, and which has various different modes of travel. The inventor has, therefore, provided a toy vehicle assembly, disclosed in U.S. Pat. No. 4,329,810 issued May, 18, 1982, having a support member provided closer to the rear of the toy vehicle to hold a weighted member such as a monetary coin, and mounting the weighted member thereon allows the toy vehicle not only to run normally, but also run with its front wheel assembly lifting off the support surface.

The toy vehicle assembly disclosed in U.S. Pat. No. 4,329,810, however, has a limitation in its modes of travel, and accordingly additional improvements are still possible.

Therefore the appearance of a toy vehicle having more running variations has been awaited.

SUMMARY OF THE INVENTION

It is, therefore, a primary object of the present invention to provide a toy vehicle assembly which allows children to amuse themselves by playing therewith in various ways, by supporting the mount for the weighted member such as a coin of monetary value by an arm member the position of which is adjustable so that it is possible to modify the mode of travel of the toy vehicle with its front wheel assembly lifted off the support surface by variously regulating the position of the mount.

Generally speaking, according to the invention, a toy vehicle assembly is provided comprising: a weighted member; a housing member having a configuration which simulates a vehicle, including an upper body shell and a lower frame member; a front wheel assembly attached to the housing member; a rear wheel assembly including an axle and a pair of wheels attached to the housing member; and a support member supporting the weighted member attached to the rear wheel assembly side of the housing member, wherein the support member includes an arm member with a weighted member holder holding the weighted member provided at one end of the arm member, the other end of the arm member being attached to the upper body shell of the housing member, the arm member being rotatable about a plurality of axes in directions different from each other.

According to another feature of a preferred embodiment, the arm member includes a base and a support rod, the base being rotatably attached to the upper body shell of the housing member as well as being connected to one end of the support rod by a pin joint.

Moreover, in the preferred embodiment, the weighted member holder includes a weighted member holding plate attached to the other end of the support rod, and a first bracket and a pair of retaining projections provided on one surface of the holding plate, whereby the weighted member is supported on that surface of the holding plate by the holding plate, the first bracket and the pair of retaining projections.

A pair of second brackets are provided on the other surface of the holding plate, whereby a second weighted member can be supported on the other surface of the holding plate by the pair of second brackets.

The invention accordingly comprises the features of construction, combination of elements, and arrangement of parts which will be exemplified in the construction hereinafter set forth, and the scope of the invention is set forth in the claims appended hereto.

BRIEF DESCRIPTION OF THE DRAWINGS

A more complete appreciation of the present invention and many of the attendant advantages thereof will be readily understood by reference to the following detailed description when considered in connection with the accompanying drawings in which.

Figure 7:
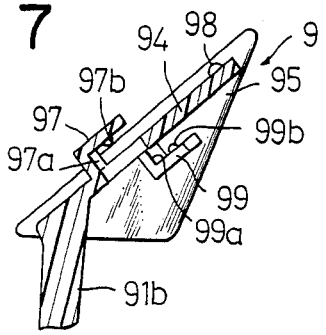
Figure 8:
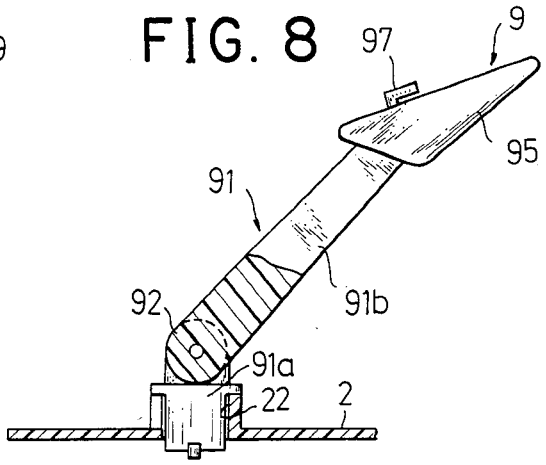
Figure 9:
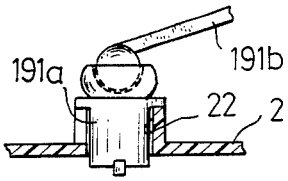
Figure 10:
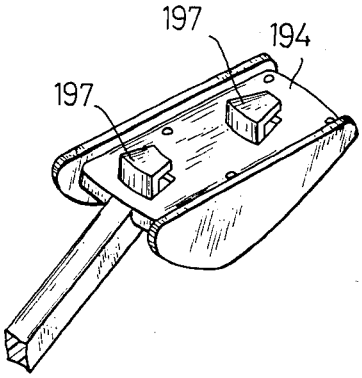
Figure 11:
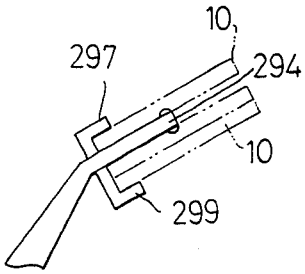
Figure 12:
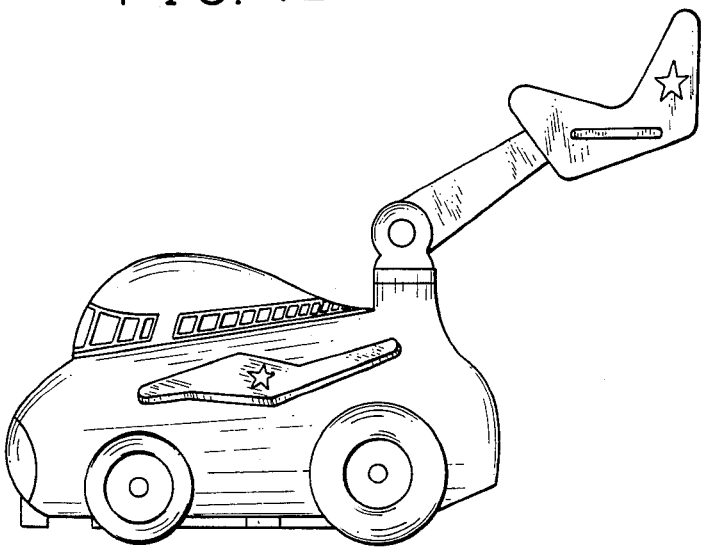

FIG. *6a* is a perspective view showing the arrangement of one surface of the weighted member holder;

FIG. *6b* is a perspective view showing the arrangement of the other surface of the weighted member holder;

FIG. 7 is a sectional side elevation of the weighted member holder;

FIG. 8 is a sectional side elevation of an essential part of an arm member;

FIG. 9 is a sectional side elevation of an essential part of another example of the arm member;

FIGS. 10 and 11 are a perspective view and a sectional side elevation, respectively, of other examples of the weighted member holder; and FIG. 12 is a side view of a toy airplane assembly to which the invention is applied.

DETAILED DESCRIPTION OF THE PREFERRED EMBODIMENTS

The following description is provided to enable any person skilled in the toy industry to make and use the present invention and sets forth the best modes contemplated by the inventor for carrying out his invention. Various modifications, however, will remain readily apparent to those skilled in the art, since the generic principles of the present invention have been defined herein specifically to provide a novel toy vehicle assembly.

Figure 1:
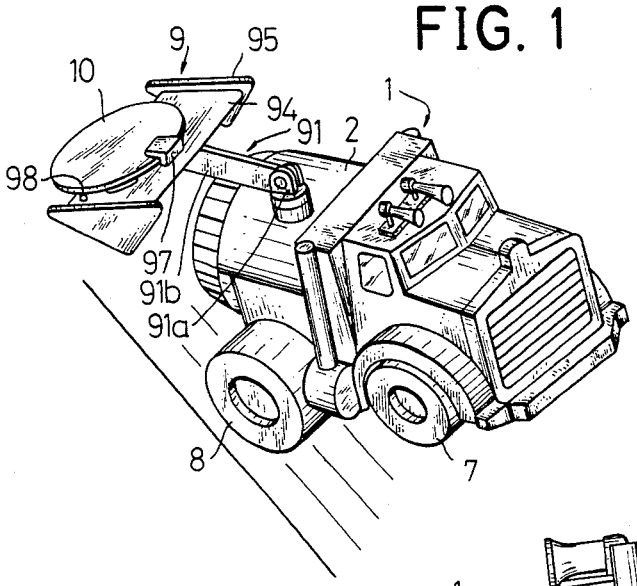
FIG. 1 is a perspective view of a toy vehicle assembly running with its front wheels lifted off the support surface.
Figure 2:
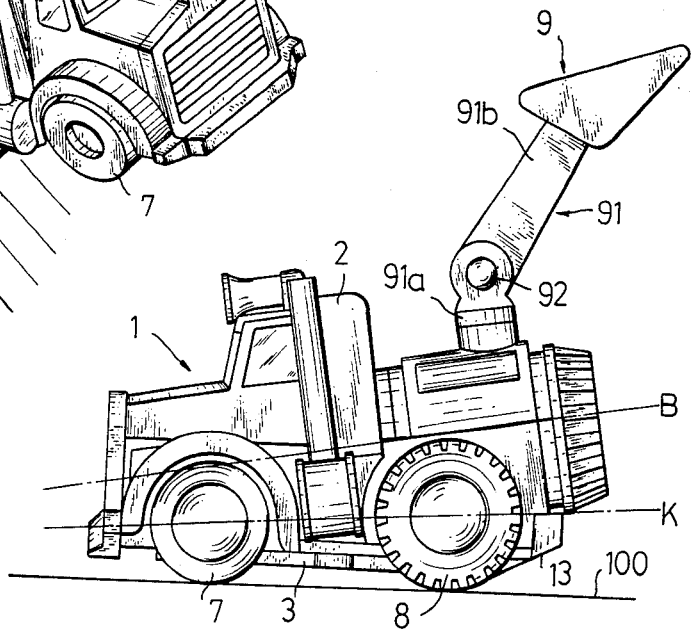
FIG. 2 is a side elevation of the toy vehicle assembly.
Figure 3:
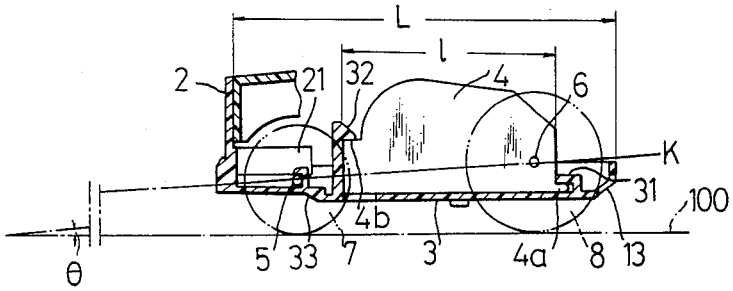
FIG. 3 is a side elevation of the toy vehicle assembly with its upper body shell shown in FIG. 2 removed.

Referring now to the figures wherein like reference characters designate identical or corresponding parts throughout the several views and, more particularly, to FIGS. 1, 2 and 3. The toy vehicle assembly in accordance with a preferred embodiment of the invention shown in these figures comprises a vehicle housing 1 constituted by an upper body shell 2 and a lower frame member 3, a motor assembly 4 mounted on the vehicle housing 1, a front axle 5 and a rear axle 6 attached to the lower frame member 3 and the motor assembly 4 respectively, front wheels 7 and rear wheels 8 attached to the front axle 5 and the rear axle 6 respectively, and a weighted member holder 9 mounted by an arm member 91 closer to the rear part of the upper body shell 2.

The upper body shell 2 and the lower frame member 3 is a combination constituting the vehicle housing 1 and each are molded of plastic and integrally screwed to each other by means of a screw (not shown).

The upper body shell 2 of the embodiment is designed to simulate a truck having a jet engine mounted on its rear part. This configuration of the upper body shell 2 is, however, not exclusive and it is possible to simulate the configurations of various automobiles.

The lower frame member 3 has a retaining tab 31 provided toward the rear of its upper surface and a retaining hook 32 provided toward the front thereof. In addition, bearing hooks 33 for rotatably supporting the front axle 5 are provided in the vicinity of the retaining hook 32.

A guide member or portion 13 forms a slanting surface at the rear end of the lower frame member 3. The guide member 13 is configured to contact and slide along a support surface 100 when the front wheels 7 are lifted off the support surface 100. The guide member 13 is positioned so as to support the toy vehicle when it is rotated about the rear axle 6. Accordingly, the toy vehicle, when propelled forward, provides an impression of high speed acceleration with its front wheel assembly lifted off the support surface 100 as a result of the weight of the weighted member.

The motor assembly 4 has a retaining plate **4*a* formed on its rear side which engages with the retaining tab 31, and a step 4*b* formed on its front side which retains the retaining hook 32. The motor assembly 4 is firmly mounted on a substantially central part of the lower frame member 3** by the engagement and retaining effected by these parts.

Figure 4:
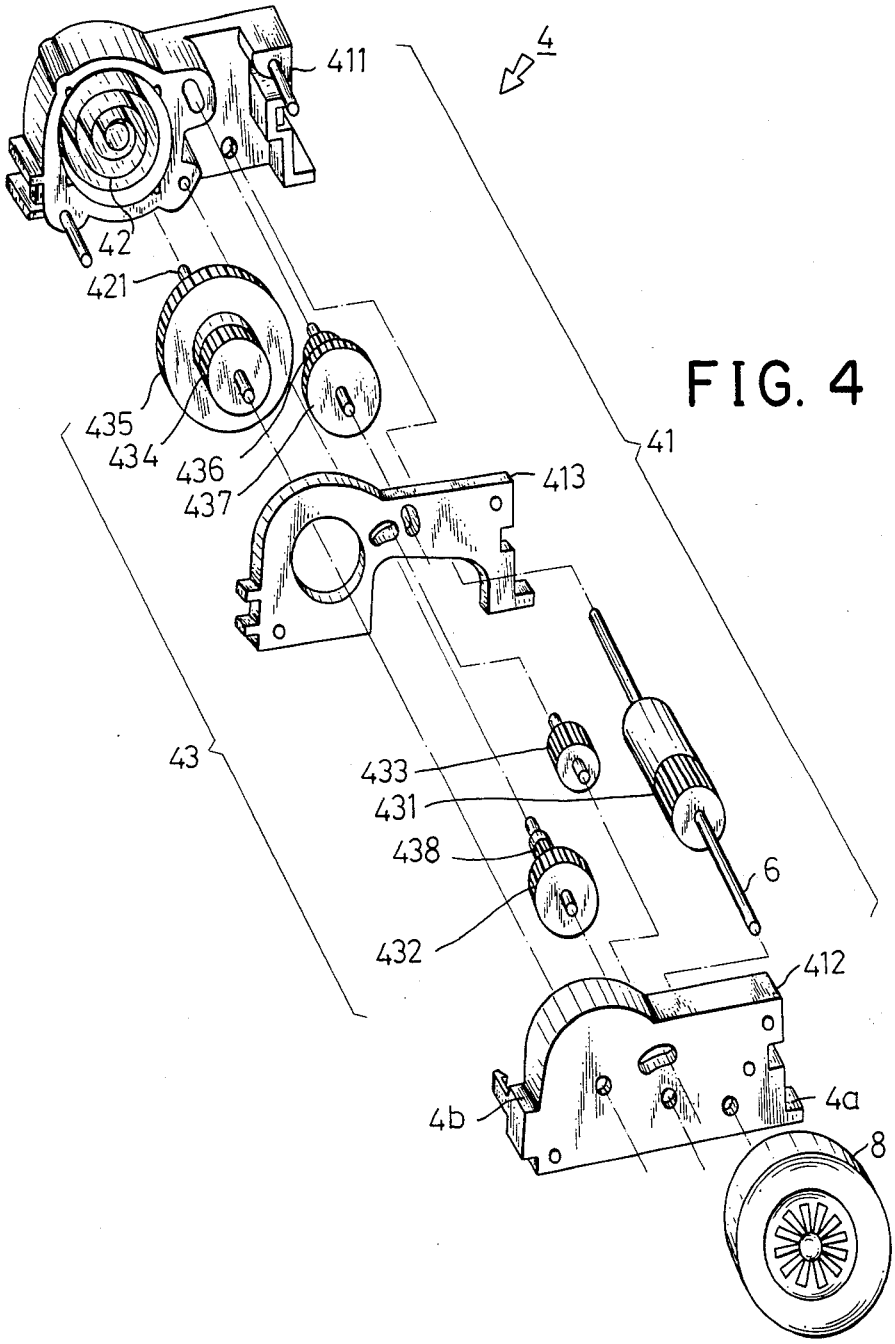
FIG. 4 is an exploded perspective view of an example of a motor assembly.

The motor assembly 4 is a self-contained motor assembly formed by incorporating in a motor housing 41 a pull-back type of spring 42 and a gear train 43 transmitting the power from the spring 42 to the rear axle 6. Referring now to FIG. 4 showing an example of the motor assembly 4, the motor housing 41 comprises side shells 411, 412 and an intermediate plate 413 clamped therebetween and made of a plastic resin. The motor housing 41 accomodates the spring 42 and the gear train 43. The gear train 43 has a winding system, i.e., a system for storing energy in the spring 42, and a driving system, i.e., a system for driving an output shaft, thereby allowing power to be reciprocally transmitted between the spring 42 and the rear axle 6. The gear train 43 is formed so that it is lightweight by employing a plastic resin having a modulus of elasticity of, for example, 0.3.

The winding system of the gear train 43, i.e., the system for storing energy in the spring 42, comprises a pinion 431 secured to the rear axle 6 attached to the housing 41, a first spur gear 432 constantly engaging the pinion 431, a winding pinion 433 engaging the spur gear 432, and a small gear wheel 434 secured to a spring shaft 421 and engaging the pinion 433. The winding pinion 433 is movably borne so that it engages the spur gear 432 only during the winding-up of the spring.

The driving system, i.e., the system for driving an output shaft, comprises a large gear wheel 435 secured to the spring shaft 421, a driving pinion 436 engaging the large gear wheel 435, a second spur gear 437 formed integrally with the pinion 436 and engaging a pinion 438 formed integrally with the first spur gear 432. The driving pinion 436 is movably born so as to engage the large gear wheel 435 only during the driving of the toy car. It must be noted that the above first spur gear 432 and the pinion 431 function as gears in the driving system.

The speed ratio of the rear axle 6 to the spring shaft 421 of the above gear train 43 is 1.18 for the winding system and 25.45 for the driving system. Therefore, a 1.18 revolution of the rear axle 6, i.e., the rear wheels 8, winds the spring 42 one revolution, while unwinding the spring 42 one revolution rotates the rear axle 6, i.e., the rear wheels 8, 25.45 revolutions. Accordingly, a sufficiently large energy can be stored by a short pull-back distance, i.e., retreat distance, and a high-speed long-distance running is made possible by releasing the energy little by little.

The ratio l/L of the length l of the motor assembly 4 to the length L of the lower frame member 3 is set to be larger than 0.5. Accordingly, since the motor assembly 4, which has the largest weight of the constituent elements of the toy vehicle assembly, is positioned in the substantially central part of the vehicle housing 1, it is possible to stabilize the running of the toy vehicle as well as allow it to change course easily when it collides with an obstacle or the like.

The front axle 5 has the front wheels 7 attached to the right and left ends thereof, and is supported by the bearing hooks 33 of the lower frame member 3 as well as a projection 21 extending from the front bumper of the upper body shell 2 so that it is prevented from coming off the lower frame member 3 easily. The rear axle 6 with the rear wheels 8 attached to the right and left ends thereof, has its central portion directly incorporated into the motor assembly 4 as the output shaft thereof as described above. In addition, since the rear axle 6 is made longer than the front axle 5, the distance between the attached rear wheels 8 is larger than that between the attached front wheels 5. Moreover, the diameter and width of each of the rear wheels 8 are made larger than those of each of the front wheels 7. Therefore it is possible to improve the stability of the toy vehicle, as well as prevent it from rolling laterally, when running by those arrangements. In the embodiment, the diameter of each of the front wheels 7 is 17 mm, the width thereof is 8 mm, the diameter of each of the rear wheels 8 is 20 mm, the width thereof is 10 mm, the length of the front axle 5 is 30 mm, that of the rear axle 6 is 36 mm, the distance between the pair of attached front wheels 7, i.e., the distance between the side surfaces of the front wheels 7 is 38 mm, and the distance between the pair of attached rear wheels 8, i.e., the distance between the side surfaces of the rear wheels 8, is 46 mm.

Moreover, as described above, the diameter of each of the rear wheels 8 is made larger than that of each of the front wheels 7 in order to set the relationship between the height of the front axle 5 and that of the rear axle 6 from a flat support surface 100 so that a plane K including the front axle 5 and the rear axle 6 will intersect the flat support surface 100 in front of the front axle 5 at an angle $\theta$ as shown in FIG. 3. In addition, a body line B is made to have a larger angle than the angle $\theta$ with respect to the flat support surface 100. In consequence, the vehicle housing 1 as a whole is inclined forward. Accordingly, it is possible to improve the stability of the toy vehicle when running as well as allow it to easily effect a course change to a different direction when it collides with an obstacle or the like. In the embodiment, the angle $\theta$ is 4 degrees.

Figure 5:
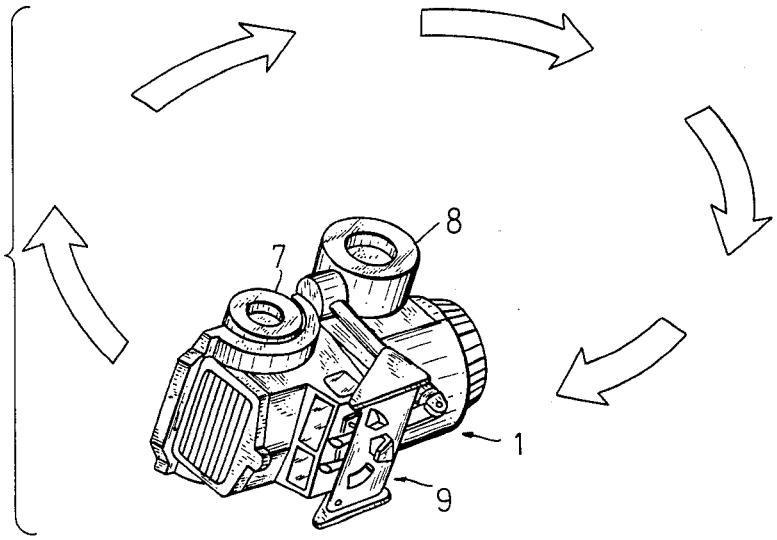
FIG. 5 is a perspective view of the toy vehicle assembly rotating about its rear axle while lying on its side.
Figure 6A:
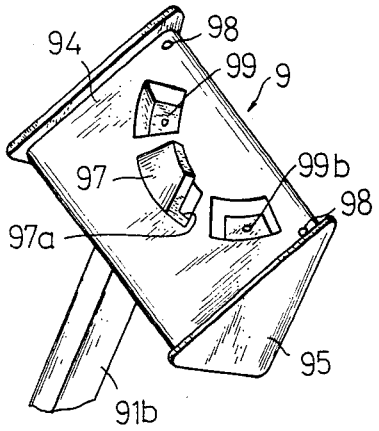
Figure 6B:
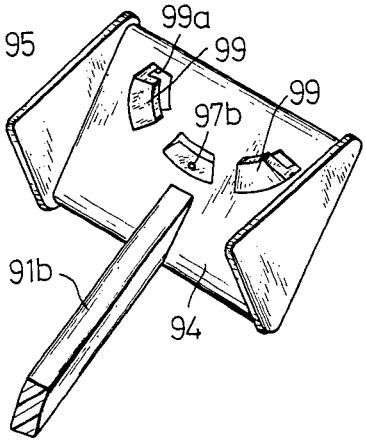

Further, it is also possible to enjoy playing with the toy car in the position shown in FIG. 5 by making the distance between the attached rear wheels 8 larger than that between the attached front wheels 7 and also by making the diameter and width of each of the rear wheels 8 larger than those of each of the front wheels 7 as described above. More specifically, when the rear wheels 8 are driven with the toy vehicle lying on its side, the vehicle housing 1 rotates about its rear wheels 8 projecting from the vehicle housing 1, thereby making the toy vehicle rotate. If this rotation takes place after the toy vehicle has accidentally rolled over during running, the rotation succeeds the normal running of the toy vehicle, or the running thereof with its front wheels 7 lifted off the support surface 100, and provides a more amusing impression.

The weighted member holder 9 is mounted on the upper body shell 2 by the arm member 91 closer to the rear part of the vehicle housing 1 as shown in FIGS. 5 thru 8. More specifically, the arm member 91 has a base 91*a* and a support rod 91*b* which are connected together so that the arm member 91 can pivot through substantially 180 degrees about a pin joint 92 at the junction between the base 91*a* and the support rod 91*b*. In addition, the shaft portion of the base 91*a* is pivotally fitted in a keyhole-like aperture 22 formed in the upper surface of the upper body shell 2 of the vehicle housing 1 so that it can rotate through 360 degrees as well as be removable.

A weighted member holding plate 94 is integrally provided at the end of the support rod 91*b* of the arm member 91. The arm member 91 and the weighted member holding plate 94 are molded of a plastic resin in a similar way to that of the vehicle housing 1. The weighted member holding plate 94 is formed as a rectangular shape and has side plates 95 provided on both sides thereof. Moreover, both surfaces of the weighted member holding plate 94 are designed so as to be able to receive and support the weighted member 10 such as a coin of monetary value, e.g., a penny or nickel.

More specifically, one surface of the weighted member holding plate 94 has a bracket 97 having a circular base 97*a* and an L-shaped cross sectional configuration, provided pointing upward in a substantially central part thereof, together with a pair of small retaining projections 98 provided toward both sides of the upper part thereof. On the other hand, the other surface of the weighted member holding plate 94 has a pair of brackets 99 each having a circular base 99*a* and an L-shaped cross sectional configuration, provided, inclined at about 45 degrees inward, at positions slightly above the lateral center line of the weighted member holding plate 94 and at the same time symmetrical about the longitudinal center line thereof. Moreover, small projections 97*b*, 99*b* are formed on the inner surfaces of the brackets 97 and 99 with L-shaped cross sectional configurations, respectively, on the surfaces of the weighted member holding plate 94.

Accordingly, the weighted member holder 9 can be turned to any desired direction by the rotation of the arm member 91, and its height and angle of inclination can also be changed at will by the pin joint 92 between the base 91*a* and the support rod 91*b*. Thereby, it becomes possible to move the position of the center of gravity of the vehicle housing 1 at will by the regulation of the stationary position of the weighted member 10 with respect to the vehicle housing 1. Accordingly, it is possible to optionally modify the running conditions of the toy vehicle with its front wheels 7 lifted off the support surface 100. Moreover, it is possible to enjoy playing with a toy vehicle with various different appearances by changing the external shape thereof. Further, the weighted member holder 9 firmly clamps the weighted member 10 on one surface of the weighted member holding plate 94 by means of the bracket 97 having an L-shaped cross sectional configuration and the two retaining projections 98, and also at the other surface the weighted member holder 9 firmly clamps lower portions of a similar weighted member 10 by two brackets 99 each having an L-shaped cross sectional configuration. Furthermore, since the bases 97*a*, 99*a* of these brackets 97, 99 are formed so as to be circular, when a circular coin is used as the weighted member 10, it is received stably so that a reliable clamping can be effected. In addition, since the small projections 97*b*, 99*b* are provided on the inner surfaces of the brackets 97, 99, respectively, when the weighted member 10 such as a coin or the like is clamped by the brackets 97, 99, the projections 97*b*, 99*b* engage the peripheral edges of the coin or the like, thereby allowing the weighted member 10 to be more firmly clamped.

It must be noted that, in another example of the arm member, a base 191*a* and a support rod 191*b* can be connected together by a swivel joint as shown in FIG. 9.

Moreover, besides the example of the weighted member holding plate 94 in the above embodiment, such modifications as those shown in FIGS. 10 and 11 are possible. The example shown in FIG. 10 is such that a weighted member holding plate 194 is formed so as to be longitudinally extended, and has a plurality of brackets 197 (199) each having an L-shaped cross sectional configuration, longitudinally provided on one or both surfaces thereof, thereby making it possible to mount a plurality of weighted members 10. On the other hand, the example shown in FIG. 11 has brackets 297, 299 each having an L-shaped cross sectional configuration formed on one or both surfaces of a weighted member holding plate 294 so that there is a large clamping distance between each bracket and the corresponding surface, so that a plurality of weighted members 10 such as coins or the like can be mounted simultaneously. If the weighted member holding plate is constructed so as to be able to mount a plurality of weighted members 10 removably as in these examples, it becomes possible to regulate the number of weighted members 10 mounted. Accordingly, the running conditions of the toy vehicle can be varied at will by the movement of the center of gravity of the vehicle housing 1.

Various further modifications are possible. For example, the weighted member holding plate could be circular or triangular. Moreover, besides the pivotal connection between the base 91*a* and the support rod 91*b* of the arm member 91, the support rod 91*b* and the weighted member holding plate 94, for example, can be pivotably connected together by a pin joint, a swivel joint or the like. In such a case, the stationary position of the weighted member holder 9 can be further regulated properly. Moreover, since the arm member 91 is removably fitted in the keyhole-like aperture 22 of the vehicle housing 1, if a plurality of weighted member holders 9 different in configuration from each other are prepared, it becomes possible to interchange them, so that a single toy vehicle can provide various enjoyable modifications.

The toy vehicle having the above construction is used in play as follows. When the vehicle is to run normally, the vehicle housing 1 of the toy vehicle is pulled backward to store a sufficient quantity of energy for driving the motor assembly 4, and then the vehicle is released so as to run. In this case, the arm member 91 has been rotated as well as pivoted in order to position the weighted member holder 9 properly, thereby allowing the vehicle to run normally with various different running appearances. When the toy vehicle is to be propelled with its front wheels 7 lifted off the support surface, the required number of weighted members 10 are mounted on the weighted member holding plate 94, and the arm member 91 is rotated as well as pivoted in order to position the weighted member holding plate 94 properly, i.e., the weighted members 10, and then the vehicle housing 1 is pulled backward and released to run. In this case, the toy vehicle runs according to the number of the weighted members 10 and the positions thereof. In both the normal running of the vehicle, and the running thereof with its front wheels lifted off the support surface, owing to the fact that the diameter and width of each of the rear wheels 8 are larger than those of each of the front wheels 7, and that the distance between the attached rear wheels 8 is larger than that between the attached front wheels 7, and moreover that the motor assembly 4 is mounted on a substantially central part of the vehicle housing 1, the running of the vehicle is very stable, and yet the vehicle can easily change its course to a different direction if it collides with an obstacle while running.

On the other hand, when playing with the toy vehicle by making it rotate, the vehicle housing 1 is pulled back to store driving energy in the motor assembly 4. Under this state, the vehicle housing 1 is rolled over and then released. Thereupon, the vehicle is allowed to rotate about the rear axle the rotation of the rear wheels 8 projecting from the vehicle housing 1, and it turns round and round. It is also possible to make the toy vehicle run normally, or run with its front wheels lifted off the support surface, and then rotate it about its rear axle after it rolls over, by making the vehicle run on a steep slope to roll it over deliberately.

As has been described, according to the invention, it is possible to enjoy the running of the toy vehicle with its front wheels lifted off the support surface, in addition to the normal running, by mounting a weighted member thereon, since a pivotable arm member is provided closer to the rear part of the upper body shell of the vehicle and a weighted member holding plate is provided on the arm member. Moreover, it is also possible to move the center of gravity of the vehicle as appropriate by varying the stationary position of the weighted member holding plate, i.e., the weighted member, by pivoting the arm member, thereby making it possible to enjoy a variety of modes of travel. Further, because the stationary position of the weighted member holder is varied by pivoting the arm member, the appearance of the toy vehicle is modified, so that it is possible to enjoy changing the appearance of the vehicle. Furthermore, since a coin can be employed as the weighted member, it is unnecessary to prepare a special weighted member. In addition, since coins are flat, it is possible to simplify the construction of the weighted member holding plate as well as ensure the reliable mounting of a coin thereon.

In the above embodiment, the upper body shell of the housing member has a configuration which simulates a car. However, it will be readily understood that the upper body shell could have a configuration which simulates an airplane as shown in FIG. 12, or it could have any other desired configuration. Since in this case the constructions of the parts other than the upper body shell can be the same as those in the above embodiment, any detailed description thereof will be unnecessary herein.

It will thus be seen that the objects set forth above, among those other objects made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A toy vehicle assembly adapted to receive a removable weighted member comprising:

a housing member having a configuration which simulates a vehicle, including an upper body shell and a lower frame member;

a front wheel assembly attached to said housing member;

a rear wheel assembly including an axle and a pair of wheels attached to said housing member, and a support member for supporting said weighted member attached to the rear wheel assembly side of said housing member, wherein said support member includes an arm member with a weighted member holder for holding said weighted member provided at one end of the arm member, the other end of the arm member being movably attached to said upper body shell of the housing member, the arm member being rotatable about a plurality of axes in directions different from each other, wherein said weighted member holder includes a weighted member holding plate attached to said support member having a first bracket and a pair of retaining projections provided on a first surface of the holding plate, whereby said weighted member can be removably supported on the first surface of said holding plate by the holding plate, the first bracket, and the pair of retaining projections.

2. The toy vehicle assembly as set forth in claim 1, wherein said arm member includes a base and a support rod, the base being rotatably attached to said upper body shell of the housing member as well as being connected to one end of said support rod by a pin joint.

3. The toy vehicle assembly as set forth in claim 1, wherein said arm member includes a base and a support rod, the base being attached to said upper body shell as well as connected to one end of said support rod by a swivel joint.

4. The toy vehicle assembly as set forth in claim 1, wherein said weighted member holder has a second surface and a pair of second brackets are provided on the second surface of said holding plate, whereby said weighted member can be supported on the second surface of said holding plate by the pair of second brackets.

5. The toy vehicle assembly as set forth in claim 2, wherein the base of said arm member is removably attached to said upper body shell of the housing member.

6. The toy vehicle assembly as set forth in claim 3, wherein the base of said arm member is removably attached to said upper body shell of the housing member.

7. The toy vehicle assembly as set forth in claim 1, wherein a small projection is formed on the inner surface of said first bracket to provide a frictional fitting for said weighted member.

8. The toy vehicle asembly as set forth in claim 4, wherein a small projection is formed on an inner surface of each of said second brackets to provide a frictional fitting for said weighted member.

9. The toy vehicle assembly as set forth in claim 1, wherein the base of said first bracket for receiving said weighted member has a configuration corresponding to the outer peripheral configuration of said weighted member.

10. The toy vehicle assembly as set forth in claim 4, wherein a base portion of each of said second brackets for receiving said weighted member has a configuration corresponding to the outer peripheral configuration of said weighted member.

11. The toy vehicle assembly as set forth in claim 1, wherein said weighted member holding plate is prvitally attached to said support rod.

12. The toy vehicle assembly as set forth in claim 1, wherein said first bracket has a substantially L-shaped cross-sectional configuration to provide a slotted opening, the width of said slotted opening being approximately that of said weighted member.

13. The toy vehicle assembly as set forth in claim 4, wherein each of said second brackets has an L-shaped cross-sectional configuration to provide a slotted opening extending parallel to said holding plate, the width of said slotted opening being approximately that of said weighted member.

14. The toy vehicle assembly as set forth in claim 1, wherein a plurality of groups of said first bracket and pair of retaining projections are provided on the first surface of said holding plate.

15. The toy vehicle assembly as set forth in claim 4, wherein each of said second brackets has an L-shaped cross-sectional configuration to provide a slotted opening extending parallel to said holding plate, the width of said slotted opening being approximately that of a plurality of weighted members.

16. The toy vehicle assembly as set forth in claim 1, wherein said weighted member is a coin of monetary value.

17. The toy vehicle assembly as set forth in claim 1, further including a guide member on the housing member configured to contact and slide along a support surface when the front wheel assembly is lifted off the support surface, said guide member being positioned to support the vehicle assembly when it is rotated about the rear axle.

18. The toy vehicle assembly as set forth in claim 1, further including a self-contained motor assembly mounted only on the lower frame member and operatively connected to said rear wheel assembly.

19. The toy vehicle assembly as set forth in claim 18, wherein said self-contained motor assembly includes a spring-powered prime mover.

* * * * *